US011084311B2

(12) United States Patent
McAlpine et al.

(10) Patent No.: US 11,084,311 B2
(45) Date of Patent: Aug. 10, 2021

(54) RECEIVER MATERIAL HAVING A POLYMER WITH NANO-COMPOSITE FILLER MATERIAL

(71) Applicant: Illinois Tool Works Inc., Glenview, IL (US)

(72) Inventors: Morven McAlpine, Ipswich (GB); Richard Ellis, Brantham (GB)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/284,350

(22) Filed: Feb. 25, 2019

(65) Prior Publication Data

US 2019/0184728 A1 Jun. 20, 2019

Related U.S. Application Data

(63) Continuation-in-part of application No. 15/873,432, filed on Jan. 17, 2018, now Pat. No. 10,214,042, which is a continuation of application No. 12/919,785, filed as application No. PCT/GB2009/050169 on Feb. 20, 2009, now Pat. No. 9,873,278.

(30) Foreign Application Priority Data

Feb. 29, 2008 (GB) ..... 0803760

(51) Int. Cl.
*B41M 5/52* (2006.01)
*B41M 7/00* (2006.01)

(52) U.S. Cl.
CPC ..... *B41M 5/5218* (2013.01); *B41M 7/0027* (2013.01); *B41M 2205/02* (2013.01); *B41M 2205/10* (2013.01)

(58) Field of Classification Search
CPC ..... B41M 5/5218; B41M 2205/02; B41M 2205/10; B41M 7/0027
See application file for complete search history.

(56) References Cited

U.S. PATENT DOCUMENTS 5,277,980 A 1/1994 Mino
5,633,114 A 5/1997 Waterman
5,753,590 A 5/1998 Harrison et al.
6,841,226 B2 1/2005 Dontula et al.
6,989,350 B2 1/2006 Hirota et al.
2002/0145132 A1 10/2002 Won et al.
2003/0129385 A1* 7/2003 Hojo ..... B29C 59/046 428/323
2004/0194691 A1 10/2004 George et al.
2005/0132518 A1 6/2005 Chen et al.
2005/0134656 A1* 6/2005 Gao ..... B41M 5/42 347/71
2005/0137089 A1 6/2005 Gao et al.
2005/0170192 A1 8/2005 Kambe et al.
2006/0122309 A1* 6/2006 Grah ..... C08K 9/04 524/445
2007/0208123 A1 9/2007 Kambe et al.
2008/0125535 A1* 5/2008 Wang ..... C08L 2666/02 524/445
2009/0087728 A1 4/2009 Less et al.
2011/0262666 A1 10/2011 Choy et al.
2012/0260563 A1 10/2012 Marker et al.
2015/0104656 A1 4/2015 Suga et al.
2018/0134058 A1 5/2018 McAlpine et al.

FOREIGN PATENT DOCUMENTS

CN 107828293 A 3/2018
EP 0628421 A2 12/1994
EP 2250030 A1 11/2010
JP H03126588 A 5/1991
WO WO93/08084 * 4/1993 ..... B65D 75/00

OTHER PUBLICATIONS

International Search Report and Written Opinion dated Jul. 9, 2020 for corresponding International Application No. PCT/US2020/019682 (15 pages).

* cited by examiner

*Primary Examiner* — Amina S Khan
(74) *Attorney, Agent, or Firm* — The Small Patent Law Group LLC; Philip S. Hof

(57) ABSTRACT

A transferable receiver material is provided that includes a polymer film assembly comprising inorganic particles having a first dimension smaller than 100 nanometers and an orthogonal, second dimension larger than 100 nanometers. The polymer film assembly can be coupled with a carrier film and the polymer film assembly can be configured to separate from the carrier film and couple with a target object surface along a defined edge upon application of heat. Optionally, the polymer film assembly includes a holographic image configured to be transferred to a target object surface upon application of heat. The polymer film assembly can be configured to receive one or more dyes, pigments, inks, special effect materials, or special effect metals for thermally transfer onto a target object. After transfer onto a target object, images transferred by the material are visible through the polymer film assembly.

17 Claims, 4 Drawing Sheets

RECEIVER MATERIAL HAVING A POLYMER WITH NANO-COMPOSITE FILLER MATERIAL

CROSS-REFERENCE TO RELATED APPLICATIONS

This application is a continuation-in-part of U.S. patent application Ser. No. 15/873,432, which was filed on 17 Jan. 2018, (now U.S. Pat. No. 10,214,042), and which is a continuation of U.S. patent application Ser. No. 12/919,785, which was filed on 27 Aug. 2010 (now U.S. Pat. No. 9,873,278, which issued on 23 Jan. 2018), which is a national stage entry of PCT Application No. PCT/GB2009/050169, which was filed on 20 Feb. 2009, which claims priority to Great Britain Application No. 0803760.8, which was filed on 29 Feb. 2008. The entire contents of each of these applications are incorporated herein by reference.

FIELD

The present invention relates to a receiver materials that may be used in thermal transfer applications. For example, one or more embodiments described herein can be used to create receiver materials that are included in a thermal transfer ribbon. Optionally, the receiver materials described herein can be used in applications other than thermal transfer applications.

BACKGROUND

Dye diffusion thermal transfer printing is a process in which one or more thermally transferable dyes are transferred from selected areas of a dye sheet to a receiver material by localized application of heat, thereby to form an image. Full color images can be produced in this way using dyes of the three primary colors, yellow, magenta and cyan. Printing is conveniently carried out using a dye sheet in the form of an elongate strip or ribbon of a heat-resistant substrate, typically polyethylene terephthalate polyester film, carrying a plurality of similar sets of different colored dye coats, each set comprising a panel of each dye color (e.g. yellow, magenta and cyan plus optional black), with the panels being in the form of discrete stripes extending transverse to the length of the ribbon, and arranged in a repeated sequence along the length of the ribbon.

Dye diffusion thermal transfer printing may be used to print directly onto a variety of substrates, for example onto polyvinyl chloride (PVC). Some substrates, e.g. polycarbonate, certain polyesters and ABS, however, are not sufficiently dye receptive for good quality images to be formed by printing onto them directly.

This problem is well-known and one known solution is to apply a dye-receptive coating, also called a receiver layer, during manufacture of the substrate.

For such coatings to adhere to the substrate, the coatings must be sufficiently adhesive. As dye diffusion thermal transfer printing involves the physical contact of the printing ribbon with the substrate to be printed on, however, this can create difficulties with excessive ribbon release force or even ribbon sticking.

To overcome this problem, such coatings are typically curable so that their adhesive nature is reduced during cross-linking without the risk of the coating detaching from the substrate. To further reduce the risk of ribbon adhesion, release agents can be incorporated in the coating, e.g. silicone oil. Often, only a small region of the substrate is to be printed on, however, so coating the substrate during manufacture of the substrate can involve unnecessary costs.

An alternative solution is to transfer a receiver layer to the substrate by the application of heat. Often this involves the thermal transfer of a dyable resin with excellent adhesive properties in order that it adheres to the substrate. In this case, the receiver layer is typically not cured as curing during the coating process, i.e. prior to transfer, would hinder or prevent the transfer of the receiver layer onto the substrate. To reduce ribbon release force upon subsequent printing, release agents may be used but this often provides an insufficient reduction in the ribbon release force and problems of ribbon sticking are not eliminated, particularly where a receiver layer having excellent adhesion is used.

As a solution to this problem it has been suggested to thermally transfer two or even three layers. For example, an arrangement involving an adhesive layer followed by an image-receiving layer and an uppermost release layer has been proposed in EP 0474355.

BRIEF DESCRIPTION

In a first aspect, the subject matter described herein provides a receiver layer for use in dye diffusion thermal transfer printing comprising a release agent and a swellable inorganic lamellar material that is at least partially in an intercalated or exfoliated state.

The ribbon release force increases as successive color panels are printed onto substrates having a receiver layer. While the ribbon release force might be acceptable when printing the first color panel (e.g. yellow) or even the subsequent color panel (e.g. magenta), the release force for subsequent panels, particularly for uncured receiver layers, becomes too high.

The increase in release force as printing proceeds is believed to be due to release agent being drawn out, or "clawed back," of the receiver layer during printing. Thus, while there may be sufficient release agent during the first color print, loss of release agent may result in adhesion of the ribbon to the receiver layer during subsequent color prints.

The receiver layer may be thermally transferable.

One or more embodiments of the subject matter described herein use inorganic lamellar material which is at least partially in an intercalated or exfoliated state. Material in this state is believed to create a tortuous path within the receiver layer, hindering the movement of the release agent molecules, thus reducing the amount of release agent claw-back during printing.

This enables a receiver layer, such as a thermally transferable layer, to be produced which has excellent adhesion, is dye receptive, and has acceptable release properties in one layer. Achieving these properties in one layer allows the layer to be made more simply and at reduced cost.

Before application to the substrate, the receiver layer may be coated onto a base film such that it can be transferred onto a substrate e.g. by means of a thermal print head or by pressing through hot rollers. The receiver layer may be coated as a continuous length on the base film prior to printing or, alternatively, the receiver layer may be coated from a panel as part of a paneled dye-sheet including, for example, yellow, magenta, cyan, black and overlay panels.

The inorganic material can be a clay material and can be at least partially in an exfoliated state.

The inorganic lamellar materials, e.g. clays, used in one or more embodiments of the inventive subject matter described herein, are structurally different to traditional macrocomposites (see FIG. 1). The inorganic lamellar materials involve polymer material expanding the platelets in a macrocomposite to cause swelling due to the polymer molecules entering between the platelets to create an intercalated nanocomposite. This may be followed by further disruption of the ordering of the platelets to result in platelets dispersed within a polymer material, also known as an exfoliated nanocomposite. It is this dispersion and lack of order of the platelets which is believed to create the tortuous path within the receiver layer.

When the inorganic lamellar material is a clay, this material can be an organically modified clay such as organically modified montmorillonite smectite clays. Non-organically modified clays, however, could be used in certain circumstances, for example if water were used as the swelling agent in combination with a water-soluble polymer.

Organic modification can increase the affinity between the polymer and the lamellar material. A preferred organic modifier is based on an ammonium ion with functional groups attached, selected according to the to the polymer material used to swell the lamellar material. Such functional groups may suitably be long chain alkyl groups, hydroxyl groups, aromatic rings or just hydrogens. Organic modification can be carried out by using an ion exchange process between the lamellar material and an organic modifier. This method can also be used, e.g. to add polymerizable groups onto the lamellar material so that the polymer can be reacted onto the lamellar particles.

Disruption of the lamellar material macrocomposite structure by use of a polymer can be achieved in a number of ways. For example, the solvent (or solution) method, the melt-blending method, and the in-situ polymerization method are all suitable. The solvent (or solution) method is currently preferred.

The receiver layers may have a thickness of from 0.5 to 5.0 microns, such as from 1.5 to 3.5 microns.

It has been found that an increase in the amount of inorganic lamellar material gives a corresponding decrease in the ribbon release force, however, too high a level of clay can reduce the ability of a dye to diffuse into the receiver layer and can reduce the optical density of resulting prints. Preferably the partially exfoliated or intercalated material is present in the receiver layer at a level of from 0.5 to 8.0 wt %, more preferably at a level of from 1.0 to 5.0 wt %.

Examples of suitable release agents include silicones, phosphoric acid ester surfactants, fluorine surfactants, higher fatty acid esters and fluorine compounds. The release agent may be included in the receiver layer at a level of from 1.0 to 10 wt %, preferably from 1.0 to 5.0 wt %.

Preferably the receiver layer comprises a resin, and which desirably has excellent transfer and adhesion properties. The resin may comprise polyester, acrylic, vinyl chloride, vinyl acetates or mixtures thereof. The resin can comprise a polyester and may have a molecular weight in the range of from 6000 to 10000. If present, the resin may comprise from 70 to 99.5 wt % of the receiver layer, preferably from 80 to 99 wt %, more preferably from 90 to 99 wt %.

In one embodiment, a transferable receiver material includes a polymer film assembly comprising inorganic particles having a first dimension smaller than 100 nanometers and an orthogonal, second dimension larger than 100 nanometers. The polymer film assembly can be coupled with a carrier film and the polymer film assembly can be configured to separate from the carrier film and couple with a target object surface along a defined edge upon application of heat. Optionally, the polymer film assembly includes a holographic image configured to be transferred to a target object surface upon application of heat. The polymer film assembly can be configured to receive one or more dyes, pigments, inks, special effect materials, or special effect metals for thermally transfer onto a target object.

In one embodiment, a multi-layered structure includes a planar target object having a surface and a polymer film assembly coupled with the surface of the target object. The polymer film assembly includes inorganic particles having a first dimension smaller than 100 nanometers and an orthogonal, second dimension larger than 100 nanometers. The polymer film assembly includes one or more dyes, pigments, inks, special effect materials, or special effect metals for forming an image on the target object. In one example, this structure is an identification card, but optionally, can be another object.

In one embodiment, a method is provided that includes receiving one or more dyes, pigments, inks, special effect materials, or special effect metals on a surface of a polymer film assembly. The polymer film assembly includes inorganic particles having a first dimension smaller than 100 nanometers and an orthogonal, second dimension larger than 100 nanometers. The method also includes thermally printing an image on a target object using at least part of the polymer film assembly.

BRIEF DESCRIPTION OF THE DRAWINGS

The inventive subject matter will now be illustrated with reference to the following figures, in which.

DETAILED DESCRIPTION

Examples

Sample Preparation

Figure 1:
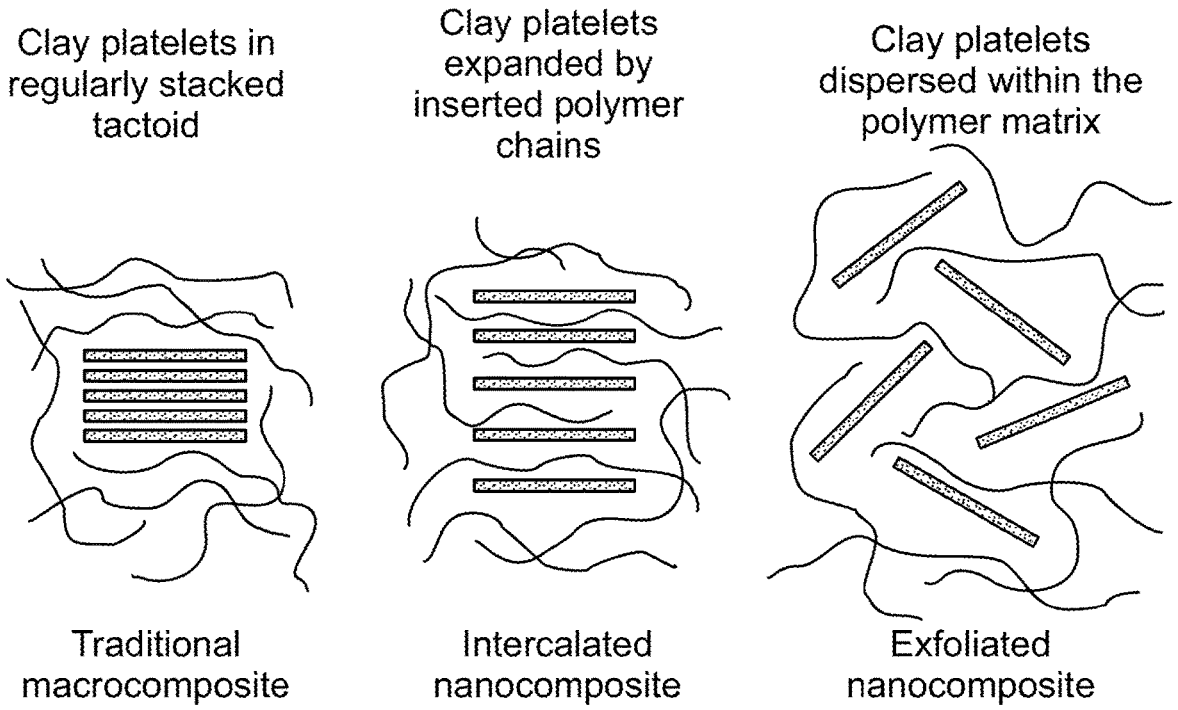
FIG. 1 is a schematic illustrating the structural differences between a traditional macrocomposite, an intercalated nanocomposite, and an exfoliated nanocomposite.

The solvent (or solution) method of nanocomposite preparation is used wherein a solvent is selected in which the polymer is soluble and the clay is swellable. The clay is first swollen in a suitable solvent. The swollen clay and polymer solution are then mixed and the polymer chains intercalate into the clay gallery displacing the solvent molecules. The solvent is then removed and a polymer-clay nanocomposite is formed. The solvent aids the exfoliation process as it acts as a swelling agent, increasing the spacing between the clay platelets prior to mixing with the polymer. There is a loss of entropy of the polymer chains as they intercalate into the clay galleries. The driving force for this to occur is the entropy gained by de-sorption of the solvent molecules.

An increase in viscosity and a lack of opacity of the dispersed clay/solvent dispersion and a lack of any settling out of clay upon standing for 24 hours were used as signs of at least partial exfoliation of the clay. A release agent was added to the clay/solvent pre-dispersion followed by addition of a resin/solvent solution, form the coating solution. Again the samples were observed for any clay dropout over time. A lack of settling out of clay was used as an indication that the clay was remaining in an exfoliated state within the coating solution. A coating was applied by hand using a Meier bar to give a wet coat weight of ~12 μm, onto a 6 μm polyester base film. The base film was already coated with a heat resistant backcoat to provide protection from the thermal head during the printing process, and a cross-linked acrylic subcoat to provide release of the receiver during transfer. The coating was dried initially by a hair drier, then in an oven at 110° C. for 30 seconds.

Example 1

Three organically modified clays (Cloisites) obtained from Southern clay products were tested. These were all montmorillonite smectite clays that differed in their organic modification. The organic modifiers of the three Cloisites are given below.

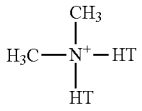

Cloisite 15A (TM) modifier

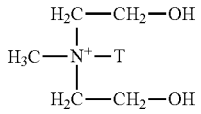

Cloisite 30B (TM) modifier

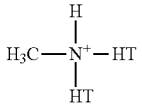

Cloisite 93A (TM) modifier

HT = Hydrogenated tallow (~65% C18, ~30% C16, ~5% C14)
T = Tallow (~65% C18, ~30% C16, ~5% C14)

A coating solution A (comparative) was prepared from:

| | |
|---|---|
| Cloisite 15A (TM) Toluene: pre-dispersion | 5% Cloisite wrt resin (1.6% wrt total weight) |
| Vylon 885 | 15.7% wrt total weight |
| MEK/Toluene 50/50 wt/wt | 82.7% wrt total weight |

A coating solution B (comparative) was prepared from:

| | |
|---|---|
| Cloisite 15A (TM) Toluene pre-dispersion | 5% Cloisite wrt resin (1.6% wrt total weight) |

-continued

| | |
|---|---|
| Vylon 885 | 15.7% wrt total weight |
| MEK/Toluene 50/50 wt/wt | 82.7% wrt total weight |

A coating solution C (comparative) was prepared from:

| | |
|---|---|
| Tegoglide 410 (TM) | 2% wrt resin (0.32% wrt total weight) |
| Vylon 885 (TM) | 16% wrt total weight |
| MEK/Toluene 50/50 wt/wt | 83.7% wrt total weight |

A coating solution D (comparative) was prepared from:

| | |
|---|---|
| Tegoprotect 5000 (TM) | 2% wrt resin (0.32% wrt total weight) |
| Vylon 885 | 16% wrt total weight |
| MEK/Toluene 50/50 wt/wt | 83.7% wrt total weight |

A coating solution E (comparative) was prepared from:

| | |
|---|---|
| Tegomer Csi2342 (TM) | 2% wrt resin (0.32% wrt total weight) |
| Vylon 885 (TM) | 16% wrt total weight |
| MEK/Toluene 50/50 wt/wt | 83.7% wrt total weight |

A coating solution F (comparative) was prepared from:

| | |
|---|---|
| Tegoglide 450 (TM) | 2% wrt resin (0.32% wrt total weight) |
| Vylon 885 (TM) | 16% wrt total weight |
| MEK/Toluene 50/50 wt/wt | 83.7% wrt total weight |

A coating solution G (according to one or more embodiments of the inventive subject matter) was prepared from:

| | |
|---|---|
| Cloisite 15A/(TM)toluene pre-dispersion | 5% Cloisite wrt resin (1.6% wrt total weight) |
| Tegoglide A115(TM) | 2% wrt resin (0.32% wrt total weight) |
| Vylon 885(TM) | 15.7% wrt total weight |
| MEK/Toluene 50/50 wt/wt | 82.4% wrt total weight |

A coating solution H (according to one or more embodiments of the inventive subject matter) was prepared from:

| | |
|---|---|
| Cloisite 15A/toluene pre-dispersion | 5% Cloisite wrt resin (1.6% wrt total weight) |
| Tegoglide 410 (TM) | 2% wrt resin (0.32% wrt total weight) |
| Vylon 885 (TM) | 15.7% wrt total weight |
| MEK/Toluene 50/50 wt/wt | 82.4% wrt total weight |

A coating solution I (according to one or more embodiments of the inventive subject matter) was prepared from:

| | |
|---|---|
| Cloisite 15A/toluene pre-dispersion | 5% Cloisite wrt resin (1.6% wrt total weight) |
| Tegoprotect 5000 (TM) | 2% wrt resin (0.32% wrt total weight) |
| Vylon 885 | 15.7% wrt total weight |
| MEK/Toluene 50/50 wt/wt | 82.4% wrt total weight |

A coating solution J (according to one or more embodiments of the inventive subject matter) was prepared from:

| | |
|---|---|
| Cloisite 15A/(TM)toluene pre-dispersion | 5% Cloisite wrt resin (1.6% wrt total weight) |

-continued

| | |
|---|---|
| Tegomer Csi 2342 (TM) | 2% wrt resin (0.32% wrt total weight) |
| Vylon 885 (TM) | 15.7% wrt total weight |
| MEK/Toluene 50/50 wt/wt | 82.4% wrt total weight |

A coating solution K (according to one or more embodiments of the inventive subject matter) was prepared from:

| | |
|---|---|
| Cloisite 15A/toluene pre-dispersion | 5% Cloisite wrt resin (1.6% wrt total weight) |
| Tegoglide 450 Tegoglide 450 | 2% wrt resin (0.32% wrt total weight) |
| Vylon 885 | 15.7% wrt total weight |
| MEK/Toluene 50/50 wt/wt | 82.4% wrt total weight |

A coating solution L (comparative) was prepared from:

| | |
|---|---|
| Cloisite 93A/toluene pre-dispersion | 5% Cloisite wrt resin (1.6% wrt total weight) |
| Tegoglide A115 | 2% wrt resin (0.32% wrt total weight) |
| Vylon 885 | 15.7% wrt total weight |
| MEK/Toluene 50/50 wt/wt | 82.4% wrt total weight |

A coating solution M (comparative) was prepared from:

| | |
|---|---|
| Cloisite 30B/toluene pre-dispersion | 5% Cloisite wrt resin (1.6% wrt total weight) |
| Tegoglide A115 | 2% wrt resin (0.32% wrt total weight) |
| Vylon 885 | 15.7% wrt total weight |
| MEK/Toluene 50/50 wt/wt | 82.4% wrt total weight |

Each of coatings B to F is for comparison with coatings G to K according to one or more embodiments of the inventive subject matter.

Vylon 885™ is a polyester available from Toyubo. Tegoglide A115™ is an organo-modified polysiloxane. Tegoglide 410™ is a polyether siloxane copolymer. Tegoprotect 5000™ is a modified polydimethyl siloxane resin. Tegomer Csi 2342™ is a linear organo-functional polysiloxane. Tegoglide 450™ is a polyether siloxane copolymer. All Tego additives are available from Degussa.

Testing

The organo-clay dispersions were observed as described in the sample preparation section above.

TABLE 1

| Organo-clay | Appearance | Appearance after stirring in solvent | Appearance after addition of pre-dispersion to polymer/solvent solution |
|---|---|---|---|
| Cloisite 15A | Off-white solid | Clear, yellow viscous fluid | No drop out of any filler, clear fluid |
| Cloisite 93A | Off-white solid | Murky, low viscosity fluid | Cloudy, some drop out of solid material |
| Cloisite 30B | Off-white solid | Murky, low viscosity fluid | Cloudy, large amount of drop out of material |

From the observations contained in Table 1, Cloisite 15A was assigned as being in at least a partially exfoliated state, whereas Cloisite 93A and 30B were assigned as being in a non-exfoliated state i.e. like a traditional clay filler. This is not to say that Cloisite 93A, Cloisite 30B or any swellable layered silicate (modified or not) could not be used in the application as disclosed herein provided that the appropriate conditions and formulation were used i.e. a solvent in which the clay is swellable, use of a polymer solution in which the clay remains in an exfoliated state or use of a different method of achieving exfoliation e.g. in situ polymerization.

The coatings were spliced into a dye-sheet and printed as a monochrome panel onto PVC and polycarbonate cards using a Pebble-3 printer (manufactured by Evolis). The receiver layer was visually assessed for transfer, looking for full coverage of the card and no flash (i.e. that the receiver layer gave a clean fracture along the edge of the printed area and there was no ragged torn edge to the panel). The receiver layer was print tested by printing a high-density colored image (red lips image with black background) on a Pebble-3 printer using a standard YMCKO dye ribbon from ICI.

Cyan peel forces were measured by first printing yellow 255 using a thermal print head set up that does not remove the dye-sheet after printing. The printed yellow dye-sheet was manually removed and then the same card was printed with magenta 255. The magenta dye-sheet was removed manually and a cyan image consisting of increasing density bars was printed. The cyan dye-sheet was not removed at this stage. The cyan dye-sheet was peeled apart from the card using an Instron 6021. The maximum peel force recorded during the removal of the dye-sheet was noted and reported as the cyan peel force for that sample.

All examples above transferred well via heating with a thermal print head, there was complete transfer of all examples with no signs of flash. Table 2 below summarizes the cyan peel force and print test results. Using the methods as described in the sample preparation section described above it was concluded that the organo-clays contained within solutions L and M were not in an exfoliated state and therefore would not be expected to provide the beneficial barrier effect to reduce claw-back of the release agent. In Table 2, TT stands for total transfer i.e. when parts of the ribbon have stuck to the card.

TABLE 2

| Coating solution | Cyan peel force (N) | Print test |
|---|---|---|
| A (comparative) | | Ribbon stuck when printing cyan |
| B (comparative) | 3.46 | Ribbon stuck at cyan |
| C (comparative) | 3.87 | Ribbon stuck at cyan |
| D (comparative) | 3.22 | Speckled cyan TT |
| E (comparative) | 3.13 | Ribbon stuck at cyan |
| F (comparative) | Stuck at magenta so couldn't measure cyan peel force | Ribbon stuck at magenta |
| G | 2.4 | Good image, no TT |
| H | 1.79 | Good image, no TT |
| I | 1.91 | Good image, no TT |
| J | 2.44 | Good image, no TT |
| K | 1.8 | Good image, no TT |
| L (comparative) | | Ribbon stuck at cyan |
| M (comparative) | | Ribbon stuck at cyan |

Figure 2:
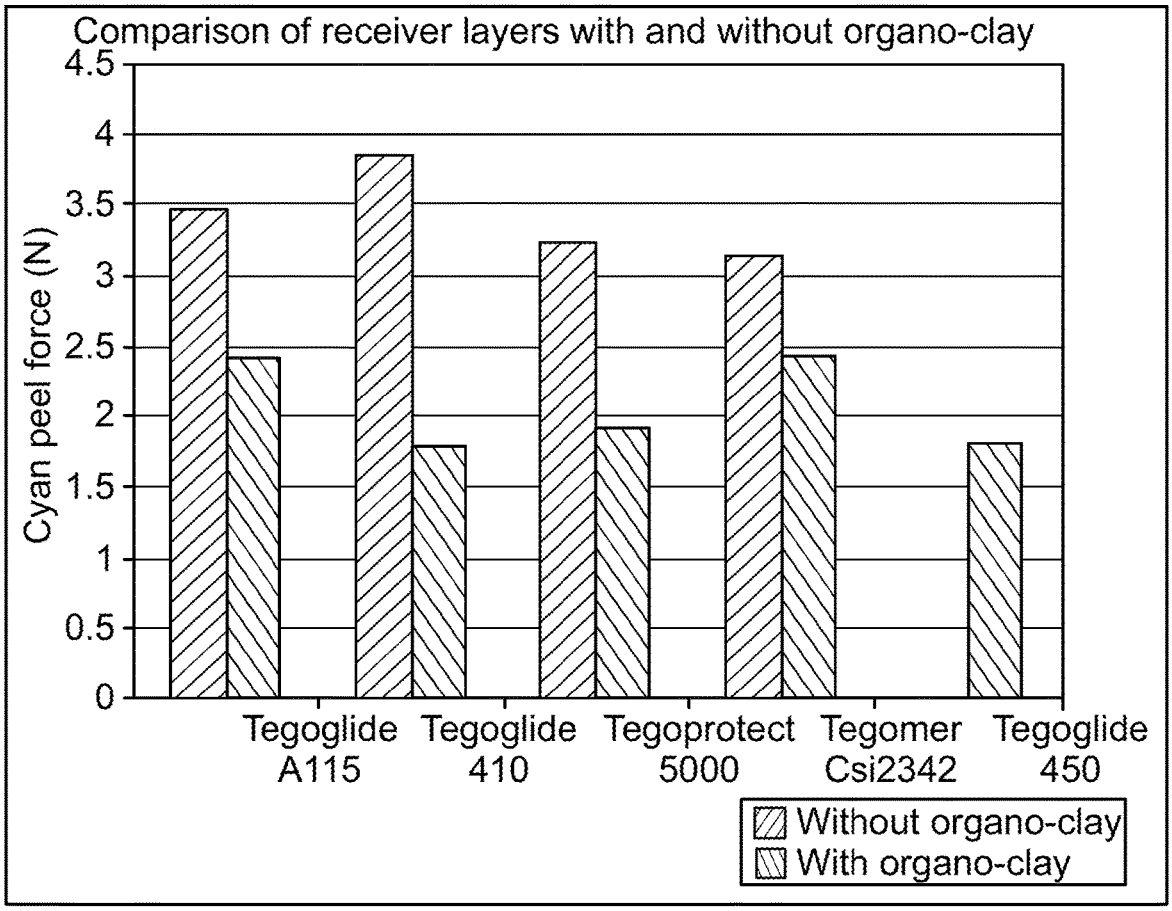
FIG. 2 is a chart showing the cyan peel force for receiver layers without clay (coatings B to E) and with clay (coatings G to K)

The cyan peel force results comparing resin+release agent receiver layers with resin+release agent+organo-clay receiver layers for coating solutions B to K are summarized in FIG. 2. Coating solution F has not been included as no value could be obtained for this sample due to the magenta ribbon sticking (could not be removed by manual peeling) before printing cyan.

It can be clearly seen that addition of an organo-clay to a receiver layer of a dyeable resin plus release agent reduces the cyan peel force and improves the dye diffusion print performance.

Example 2

Thermally transferable receiver layers were prepared and transferred as described in the sample preparation section described above. A standard YMCKO ribbon from ICI was used to print three samples as described below:

1) Increasing density cyan bars with no preceding print

Figure 3:
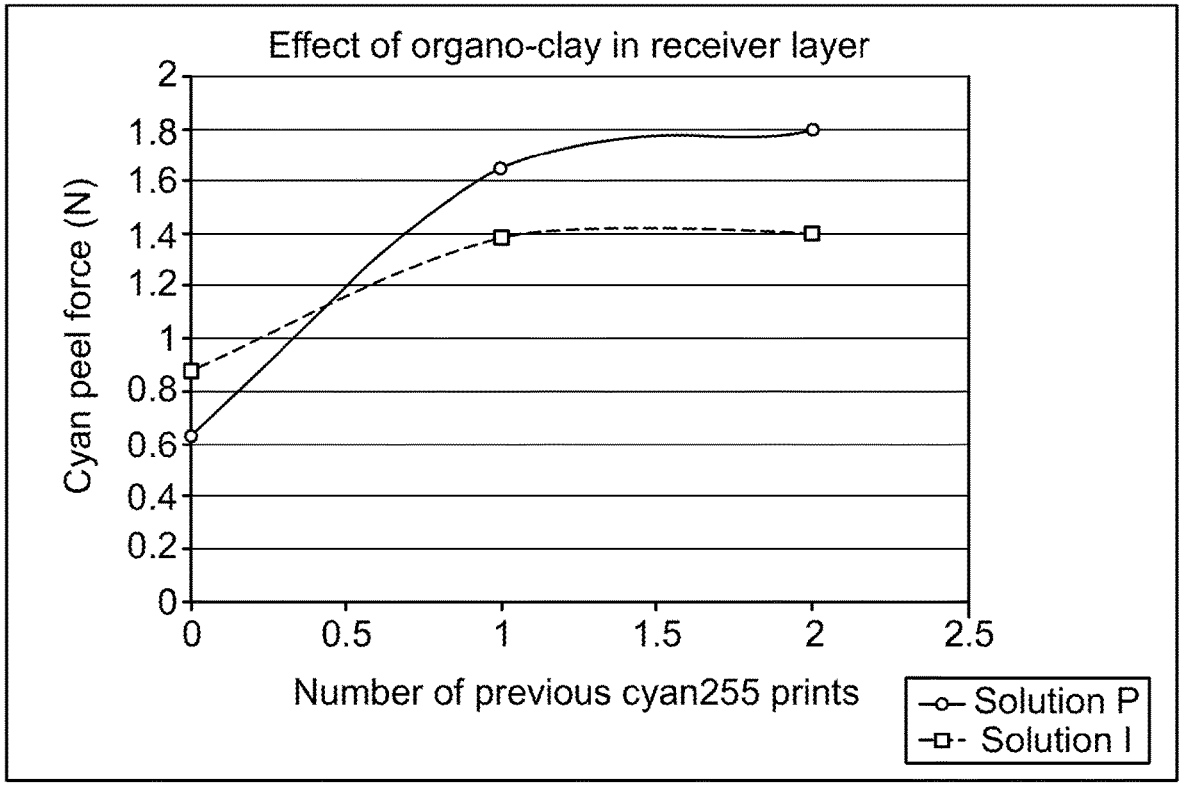
FIG. 3 is a chart showing the cyan peel force as a function of number of previous cyan 255 prints for a receiver layer without clay (coating D) and with clay (coating I)
Figure 4:
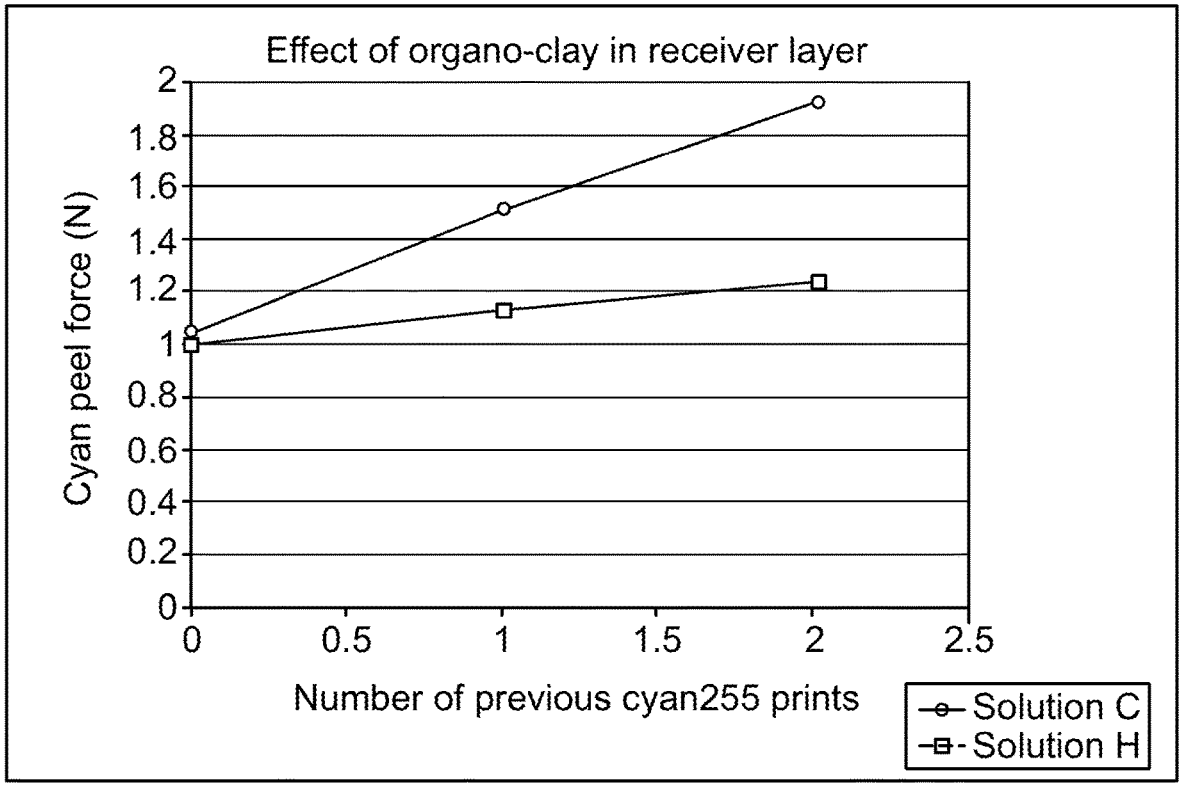
FIG. 4 is a chart showing the cyan peel force as a function of number of previous cyan 255 prints for a receiver layer without clay (coating C) and with clay (coating H)
Figure 5:
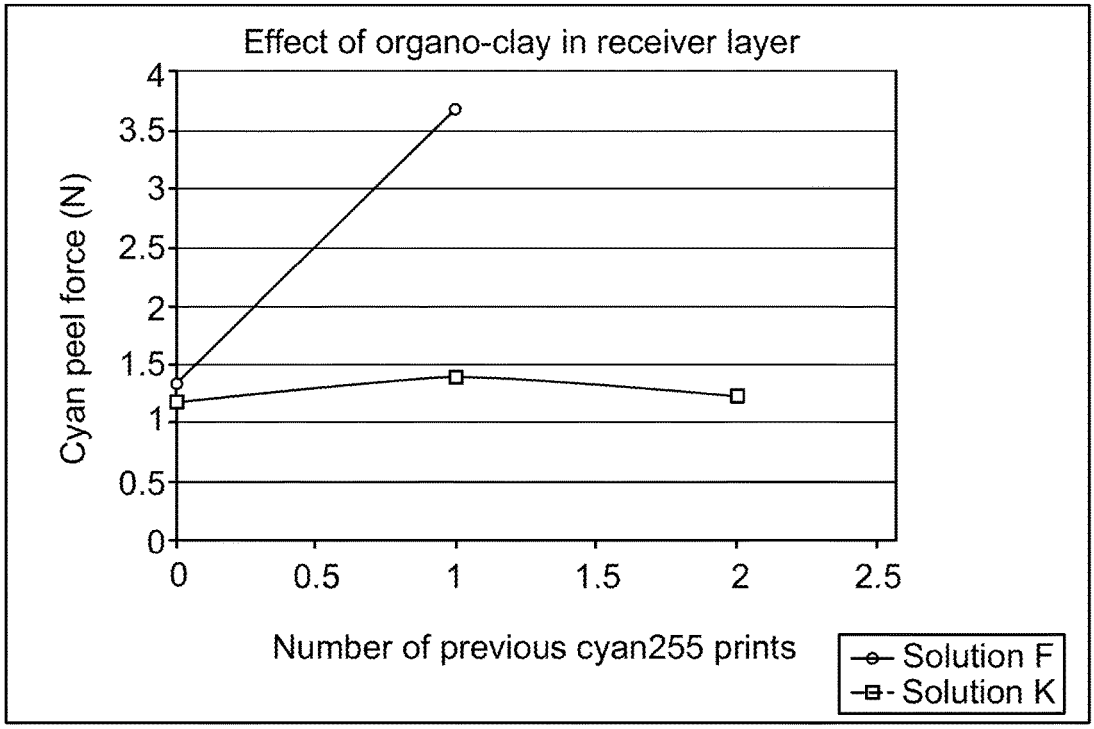
FIG. 5 is a chart showing the cyan peel force as a function of number of previous cyan 255 prints for a receiver layer without clay (coating F) and with clay (coating K)

2) One print of cyan 255, dye-sheet removed manually, followed by increasing density cyan bars 3) Two prints of cyan 255, dye-sheet removed manually, followed by increasing density cyan bars The cyan peel forces were measured as described in the testing section as described above. FIGS. 3 to 5 show the increase in cyan peel force with increasing number of preceding prints.

One or more embodiments of the inventive inorganic lamellar material that is at least partially in an intercalated or exfoliated state can be used in the manufacture of protective thermal transfer materials through which an image will be viewed. The subject matter described herein can be used in combination with a variety (or any) imaging technique, such as dye diffusion thermal transfer (D2T2) printing, also known as "dye-sub."

Dye diffusion thermal transfer printing can be used to produce color images, such as photographic images of a person, on identification documents such as national identification cards, driving licenses, or the like. This is an excellent printing technique to produce high quality, full color photographs of the document owner at point of issuance.

To print a digital image using dye diffusion thermal transfer printing, a dye-sheet containing the dyes and a substrate known as a receiver is required. The receiver substrates accept the dyes during printing and separate from the dye-sheet without sticking to allow for the printing. This can be a simple polymer that is able to accept dyes or a specially designed receiver coating that has been designed to function in a dye diffusion printer.

Accordingly, in dye diffusion thermal transfer printing, a dye-sheet or ribbon is positioned in intimate contact with a substrate, on which it is desired to print a colored image. The dye-sheet or ribbon comprises a polyester (e.g. PET) carrier film having a back-coat, and a plurality of panels affixed in a suitable manner known in the art to the PET carrier on the side opposite the back-coat. To aid adhesion of dye panels, an adhesive layer can be used on the PET carrier. This adhesive layer can be applied during base manufacture or coated onto PET prior to coating dye formulations.

Ribbons may be of a variety (e.g., any) format and panel length. Examples of ribbons include but are not limited to single color ribbons, YMC, YMCK, YMCKO, and YMCKOK ribbons, where Y=dye diffusion yellow, M=dye diffusion magenta, C=dye diffusion cyan, K=mass transfer black, and O=overlay. Other panels may also be included, which can function as either diffusion or mass transfer depending on the materials used. These panels can function as security features when using materials that are fluorescent under ultraviolet (UV) light, optically variable pigments, taggants, etc.

During dye diffusion thermal transfer printing, the dye-sheet or ribbon is indexed over the substrate such that each of the panels is positioned over the substrate in succession. A computer controlled thermal print head selectively heats each of the panels in the desired locations determined by a computer program to produce a colored image on the substrate.

When the yellow, magenta, and cyan panels are heated, in turn, the respective colored dye is diffused from the panels at the locations where the heat is applied to produce the respective color on the substrate to form the image according to the computer image program. The amount of dye transferred is dependent on the temperature of the pixel of the print head. This is different from a mass transfer printing process where the transfer is either "on" or "off," and an image is built up with a dithered pattern of colored dots. In the dye diffusion thermal transfer printing process, two hundred fifty-six shades of each component color can be achieved, and each component color can be blended with the other two component colors, giving a huge color gamut (e.g., 16.7 million colors), and hence, continuous tone images are possible. This allows for the dye diffusion process to produce very high-quality images.

There are two basic methods of dye diffusion printing: direct and retransfer. Both methods of dye diffusion printing can utilize the dye-sheet and heating method as described above.

Direct dye diffusion printing involves heating the dye-sheet and transferring the dyes in an image-wise manner directly in to the substrate that will form the final imaged document. For example, when printing a PVC identification card or driving license, direct dye diffusion printing can be utilized where the dyes are printed image-wise directly in to the PVC card surface. This PVC card forms the final identification card document and the card has received the dyes directly from the dye-sheet into the PVC via the heating method described herein. This image can then be protected with the addition of an overlay panel from a YMCKO type dye-sheet or the image can be protected with a separate cover material added from a different consumable supply, for example, a clear patch laminate material, a holographic patch, or a holographic overlay which is transferred to the printed surface of the final document via application of heat either with a thermal print head or a hot roll laminator.

To utilize the direct dye diffusion printing method, the final document substrate must be capable of receiving the dyes and of releasing the dye-sheet during the printing process. The substrate must also have a smooth and even surface to allow the dye-sheet and thermal print head to be pressed against the substrate surface under heat and pressure during the printing process without causing print defects or damaging the dye-sheet or thermal print head in the process.

The other method of printing materials with dye diffusion printing is to utilize the retransfer printing technique. Retransfer printing involves a first step of printing the dye diffusion image via the application of heat from a thermal print head, as described above, in to a specifically designed retransfer receiver film. The retransfer receiver film consists of a PET carrier film (normally of twelve to twenty-three microns thick) with clear coatings applied to one side of the PET film. These clear coatings may contain, but are not limited to: a receiver layer, an adhesive layer, a barrier layer, a tie layer, a UV protecting layer, an abrasion resistant layer, an ionizing radiation cured layer, an ionizing radiation curable layer, a thermally cured layer, a thermally curable layer, a tamper proof layer, a tamper evident layer, a reactive layer, a special effect layer, a holographic image layer, an embossed layer, an embossable layer, a high refractive index layer, a metallic layer, a top-coat protective layer, and a release layer. These layers may be utilized in any combination in any order of coating on to the PET carrier and with any of those listed added or omitted, that best suits the end use and performance requirements. The ionizing radiation can refer to light (e.g., ultraviolet light or another wavelength), electron beams, or another form of radiation. The image is printed, as described above, onto the receiver layer, which in the examples presented herein, is the upper-most layer during the printing process i.e. the layer furthest from the PET carrier film.

After printing the image in to the receiver layer of the retransfer film this material is then "retransferred" on to the final document to be imaged. The specifically designed coatings that were present on the PET carrier film are transferred off the carrier film on to the final substrate via the application of heat, typically via a hot roll laminator. The hot roll laminator typically functions in the temperature region of 130° C. to 220° C. i.e. a lower temperature range than might typically be expected for a thermal print head during the first printing process. The use of hot roll lamination for this transfer step facilitates edge-to-edge transfer as well as delivering a smooth and glossy finish to the final transferred materials, unlike similar transfer results that would be achieved by utilizing other transfer techniques such as via a thermal print head. Hot roll lamination, however, does not have the ability to be turned on and off according to an image or according to the size and shape of the final substrate on to which the material is transferred as per transfer with a thermal print head. Therefore, it is a problem known in the art that extra material can be transferred from the carrier film in undesired areas, such as over the edge of the substrate, where the carrier film is still heated by the hot roll laminator but where transfer of material is undesirable.

After transfer via hot roll lamination, the upper-most layer that functioned as the receiver layer for the dyes then becomes the layer pressed against the final substrate and the layer that was closest to the PET carrier layer, normally the protective top-coat layer, becomes the top surface of the finished substrate being the layer furthest from the final substrate surface. The specifically designed coatings that are transferred need to act both as a receiver film and then ultimately as a protective film for the image once retransferred on to the final substrate The retransfer printing technique allows the transfer of dye diffusion printed images on to substrates that might themselves not be appropriate for direct dye diffusion printing, such as polycarbonate. Retransfer printing also allows the transfer of dye diffusion printed images on to substrates that may contain irregularities in the surface, such as those containing metallic chips, that would not be suitable for direct dye diffusion printing. The retransfer printing technique also allows for "edge-to-edge" printed images on final substrates. With direct dye diffusion printing there will be an unprinted edge around the side of the final substrate as this printing technique cannot "print over the edge." With the retransfer technique the image can be printed on to the retransfer film at a slightly larger size than the final substrate so that when this is then retransferred on to the final substrate the imaged area extends fully to the edge of the final substrate. This means that the transfer definition around the edge of the card of the thermally transferrable polymer film containing the image can be important. If this film does not transfer with perfect clean edges over the edge of the final substrate this will result in a defect known as "flash."

Flash refers to extra, unwanted material that can transfer over the edge of the final substrate when transferring polymer material from a carrier film on to a substrate. This causes the look of the edge to be poor, with extra material hanging off the edge of the final substrate, thus reducing the aesthetics of the final print substrate. Flash can also result in the need for cleaning the edge of the final substrate to remove this excess material and worse still, this extra material, although transferred, is loose on the edge of the substrate so can be removed within the printer as the substrate is transported, resulting in contamination within the printing equipment, which can cause print defects in subsequent prints or require downtime for cleaning. When attempting to produce printed substrates with photographic quality imagery, these potential defects may be unacceptable. To utilize the retransfer printing technique, a retransfer film that can transfer with perfectly clean edges i.e. no flash, on to the final substrate may be desired. Perfectly clean edges can mean that the transferable film or material separates from a carrier film (as described herein) and binds to a target object surface upon the application of heat (and without use of a cutting edge or device) along one or more defined straight and/or curved edges without any part of the transferable film beyond the edges being transferred from the carrier film to the target object surface.

Once the imaged materials have transferred to the final substrate, the layers that have transferred also can act as the protective layers for the image. Post-transfer, the printed image is sandwiched between the final substrate and the layers of material that have transferred from the PET carrier on to the substrate. Therefore, these layers may need to be highly durable to act as the protective layer and also may need to have excellent optical clarity as the end user will view the printed image through these layers.

The polymer properties that would normally provide a coated material with excellent durability characteristics e.g. high Tg, high Mw, high elongation at break, high cohesive strength of a polymer, etc., are opposite properties to those that would be able to provide good clean transfer at the edges during a thermal transfer process e.g. low Mw, low cohesive strength, brittleness, low elongation at break, etc. These apparently opposing properties can be very difficult to balance to obtain the necessary characteristics from polymer materials. This is especially difficult when a multi-layer system is used, which adds coating thickness to the overall construction that can be another detrimental property to achieving clean edges upon transfer.

Therefore, it is often the case that high levels of non-polymeric materials are added in to these types of coatings to help with the transfer while utilizing tough polymers for durability or to increase durability while utilizing lower strength polymers. For example, the use of high levels of silica-type materials is known in the art to assist with sharp, clean transfer of a polymer layer. The problem with these apparent solutions to the transfer/durability balance issue, however, is that they negatively affect the optical clarity of the coatings. Adding standard inorganic filler material into a clear polymer coating at a level adequate to improve transferability will introduce haze and opacity, thus reducing optical clarity. This can be acceptable at low levels when the transferred film is not being used for high quality imaging techniques. This is not acceptable, however, when being used with the dye diffusion printing process, especially when the viewer of the image needs to look through a multi-layer system to view the printed image, where filler in each layer would have an additive detrimental effect on clarity/visual appearance To solve one or more of these problems, in one or more embodiments of the inventive subject matter described herein, the use of polymer nano-composites is proposed. Polymer nano-composite materials are materials where an inorganic material, with at least one dimension in the nano-meter range, is incorporated in to a polymer matrix to form a composite. In particular, a polymer-clay nanocomposite with inorganic material with one dimension in the nano-meter range and a second dimension significantly above the nano-meter range (i.e., a plate-like material) is proposed to achieve the most beneficial balance of improvement in transfer quality whilst maintaining optical clarity and thus superior visual appearance of a printed image viewed through such a material. For example, each particle of the nanocomposite with inorganic material may have significantly larger outer dimensions in two orthogonal directions (e.g., along x- and y-directions or axes) than the outer dimension in a third orthogonal direction (e.g., along the z-direction or axis). A dimension may be significantly larger than another dimension when the larger dimension is at least ten times larger (e.g., longer) than the smaller dimension in one embodiment. In another embodiment, a dimension may be significantly larger than another dimension when the larger dimension is at least one hundred times larger (e.g., longer) than the smaller dimension. In another embodiment, a dimension may be significantly larger than another dimension when the larger dimension is at least one thousand times larger (e.g., longer) than the smaller dimension. For example, the particles may be in the shape of rounded or circular plates having thicknesses on the order of one to one hundred nanometers while diameters of the particles in an orthogonal direction is between 0.2 and one microns.

The preparation method of forming a polymer-nano-composite material is different to that of a polymer/filler dispersion. Filler materials can be dispersed within polymer solutions via the use of simple stirring and optionally use of dispersing agents to aid the process. Creation of a polymer nano-composite can involve selecting a layered material that is capable of having these layers separated in to nano-meter thick sheets (an exfoliation process), then performing the exfoliation process and combining the exfoliated material with the polymer of choice. Materials particularly suitable for this type of exfoliation and polymer nano-composite preparation include layered double hydroxides and layered silicate materials such as montmorillonite, bentonite, laponite, vermiculiate, etc. Layered silicate clay materials that have been organically modified are particularly suitable for this process as selection of the organic modification can allow for excellent interaction between the organic modified material and the polymer material thus allowing the clay material to stay in an exfoliated state during processing and use. In one embodiment, the inorganic particles (e.g., the silicate clay materials or particles) are surface modified with oleophilic carbon-hydrogen chains.

The size of "standard" (i.e. micron) fillers means that these are visible to the naked eye once incorporated into polymer films so create a level of opacity to a polymer/filler solution and/or coating. For example, the solution or coating may be opaque when viewing with a human eye without the aid of magnification from a distance of less than ten centimeters. Due to the significantly smaller dimension in the nano-meter range of the nano-composite fillers that are described herein, these materials can be invisible to the naked eye when in solution or on a coated film. For example, the solution or coating may not be opaque or may not be visible when viewing with a human eye without the aid of magnification from a distance of less than ten centimeters.

There are "standard nano-sized" filler materials available, such as nano-silica, that are not in this exfoliated plate-like form with one dimension in the nano-meter region and one dimension above the nano-meter region. These "standard nano-filler," despite their small size, act predominantly like a standard filler. They can often have issues with agglomeration, making them more like a standard filler and even when appropriately separated, often with the use of a dispersing agent, the fillers do not provide the level of benefit afforded by exfoliated polymer-nanocomposites. At the same loading level, these fillers do not offer the improvements in thermal transfer performance afforded by the polymer-clay nano-composites proposed herein. This means that high loading levels are often used within a given formulation and thus, optical clarity and visual appearance can then be reduced. Unlike standard "nano" fillers, the proposed polymer-clay nano-composite materials would utilize a layered silicate material capable of pre-exfoliation and/or intercalation whereby the separated layers have a very high aspect ratio with one dimension in the nano-region and a second dimension above the nano-meter range.

For example, an organically modified montmorillonite clay, such as Cloisite 15 mentioned herein, is capable of being separated into disc-like platelets with thickness between 1-100 nm and diameters between 0.2 and 1 micron, thus providing an aspect ratio from 1:2 up to 1:1,000, most likely in the region of 1:200 up to 1:500. This high aspect ratio and one dimension in the nano-meter range allows these materials to provide excellent improvement in physical properties, such as transfer under the action of heat, at low addition levels relative to polymer and therefore they maintain optical clarity and excellent visual appearance of the polymer coating.

The use of nano-composite materials within polymer coatings have been previously proposed in thermal transfer media for improvement in certain performance properties, however, proposed herein is a novel use of these materials to drastically improve the transfer quality of polymer coatings under the action of heat whilst also maintaining optical clarity to allow display of photographic quality images, viewed through these coatings.

Exemplification

The organo-clay was first pre-dispersed in a swelling solvent, utilizing the solvent method of exfoliation of an organo-clay. An increase in viscosity and a lack of opacity of the dispersed clay/solvent dispersion and a lack of any settling out of filler upon standing for 24 hours were used as signs of at least partial exfoliation of the clay. The clay/solvent pre-dispersion was added to a resin/solvent solution to form a coating solution. The same resin/solvent solutions, in the absence of the clay/solvent pre-dispersion were used as coating solutions for comparative purposes.

There are several organically modified clays commercially available that could be used for the present invention. Any could be used provided the correct conditions to achieve a certain level of exfoliation and/or intercalation were used. A non-organically modified clay could also be used if for example an aqueous coating system were used. A particular example of an organically modified clay which works very well in a particular polymer system has been demonstrated within this invention, however, the general concept disclosed herein could be used with any combination of polymer with a layered filler capable of being exfoliated and/or intercalated in to platelets with one dimension in the nano-meter region and a second dimension greater than the nano-meter region.

Initially single layer coatings were prepared to demonstrate the effectiveness of the addition of the exfoliated nano-clay pre-dispersion to the polymer material on improving the transfer quality of the given polymer layer.

The nano-clay pre-dispersion was prepared in toluene as per the solution method described above using Cloisite 15, an organically modified montmorillonite smectite clay, available from BYK additives. The polymer solutions were prepared at ~16% w/w solids in 50/50 MEK/Toluene via stirring.

The polymer solutions, with and without the exfoliated nano-clay, were coated using a Meier bar that provided a wet coat-weight of 24 microns onto a 6 μm polyester base film. The base film was already coated with a heat resistant back-coat to provide protection from the thermal head during the printing process, and a releasing sub-coat to provide release of the polymer layer during transfer. The coating was dried initially by a hair drier, then in an oven at 110° C. for 30 seconds. The coatings were spliced into a dye-sheet and printed as a monochrome panel onto PVC cards using a Securion printer (manufactured by Evolis). The transferred layer was visually assessed for transfer—looking for full coverage of the card and no flash i.e. no excess material transferred over the edge of the card—as well as for clarity and lack of opacity.

Example 1 (Comparative)

Vylon 270 (Toyobo)

Example 2 (Per One or More Embodiments of the Inventive Subject Matter)

Vylon 270 (Toyobo)
+3% Cloisite 15 (pre-exfoliated in Toluene) w/w on polymer.

Example 3 (Comparative)

Dynacoll S1611 (Evonik)

Example 4 (Comparative)

Dynacoll S1611 (Evonik)
+3% Syloid 244 (Grace)

Example 5 (Per One or More Embodiments of the Inventive Subject Matter)

Dynacoll S1611 (Evonik)
+3% Cloisite 15 (pre-exfoliated in Toluene) w/w on polymer.

Example 6 (Comparative)

Vinnol H15/50 (Wacker)

Example 7 (Per One or More Embodiments of the Inventive Subject Matter)

Vinnol H15/50 (Wacker)
+3% Cloisite 15 (pre-exfoliated in Toluene) w/w on polymer.

Example 8 (Comparative)

Vylon GK880 (Toyobo)

Example 9 (Per One or More Embodiments of the Inventive Subject Matter)

Vylon GK880 (Toyobo)
+3% Cloisite 15 (pre-exfoliated in Toluene) w/w on polymer.

Example 10 (Comparative)

Ucar Mag 527 (Union Carbide)

Example 11 (Per One or More Embodiments of the Inventive Subject Matter)

Ucar Mag 527 (Union Carbide)
+3% Cloisite 15 (pre-exfoliated in Toluene) w/w on polymer.

Example 12 (Comparative)

Neocryl B805 (DSM)

Example 13 (Per One or More Embodiments of the Inventive Subject Matter)

Neocryl B805 (DSM)
+3% Cloisite 15 (pre-exfoliated in Toluene) w/w on polymer.

TABLE 3

| Example | Polymer | Tg (° C.) | Filler | Transfer Quality | Visual quality |
|---|---|---|---|---|---|
| 1 | Vylon 270 | 67 | None | Poor-flash | Good |
| 2 | Vylon 270 | 67 | Nano-clay | Good | Good |
| 3 | Dynacoll S1611 | 50 | None | Poor-flash | Good |
| 4 | Dynacoll S1611 | 50 | Syloid 244 | Some flash | Slightly grainy |
| 5 | Dynacoll S1611 | 50 | Nano-clay | Good | Good |
| 6 | Vinnol H15/50 | 74 | None | Very poor-severe flash | Good |
| 7 | Vinnol H15/50 | 74 | Nano-clay | Good | Good |
| 8 | Vylon GK880 | 84 | None | Very poor-severe flash | Good |
| 9 | Vylon GK880 | 84 | Nano-clay | Good | Good |
| 10 | UcarMag 527 | 72 | None | Very poor-severe flash | Ok |
| 11 | UcarMag 527 | 72 | Nano-clay | OK-minimal flash | OK |
| 12 | Neocryl B805 | 99 | None | Some flash | Good |
| 13 | Neocryl B805 | 99 | Nano-clay | Good | Good |

The transfer performance of all the polymers tested was drastically improved by the addition of the pre-exfoliated nano-clay. When this nano-clay material was added, no flash was observed, and the transfer was complete with good clean edges. The nano-clay had no detrimental effect on the visual quality of the polymer layers. A "standard" filler was tried with one of the polymer materials—this demonstrated a slight improvement in flash, but it did not remove it completely like the nano-clay, and it also started to introduce some deterioration in visual appearance. With the same polymer the nano-clay completely removed all signs of poor transfer/flash and gave excellent visual quality.

The use of exfoliated nano-clay filler materials to polymer layers provides a significant improvement to transfer quality without diminishing visual quality. This can be an extremely important factor when the intended product is not only a multi-layered system where transfer problems in any of the layers can be exacerbated, and highly detrimental to product quality, but also where a photographic quality image has been printed and must be viewed through these multi-layers.

Some polymers are capable of transferring from a carrier film to a substrate as neat polymer films, however, these will often have restrictions that mean choices that would be desirable for a durable protective film are opposite to choices that need to be made to facilitate clean transfer. For example, molecular weight of the polymer needs to be considered (with lower being better for transfer but worse for durability) as does thickness of the coating (with lower being better for transfer but higher being better for durability). The opposing requirements and limitations can mean that it is very difficult to obtain the correct balance of properties with a neat polymer film, hence why polymer-clay nanocomposites are proposed to obtain the ideal balance of properties.

The below Table 4 gives an example of such limitations. In this case "durability" has been presented as abrasion resistance, however, it should be noted for the purposes of the end product for which this invention is designed far more durability aspects would need to be considered such as barrier resistance to small molecule penetration—an aspect where the Tg of the polymer must be considered.

Abrasion resistance is presented as the percentage optical density remaining of a composite black printed underneath the polymer layer being worn by 500 cycles of CS-10F taber abrader wheels with a 500 g weight.

TABLE 4

| Polymer | Polymer Type | Molecular Weight | Nano-clay | Thickness | Transfer Quality | Abrasion Resistance |
|---|---|---|---|---|---|---|
| Vylon 885 | Polyester | 7500 | No | 1 micron | Good | 27% |
| Vylon 885 | Polyester | 7500 | No | 2 micron | Poor-flash | 36% |
| Vylon 270 | Polyester | 23,000 | No | 1 micron | Poor-flash | 63% |
| Vylon 270 | Polyester | 23,000 | Yes | 1 micron | Good | 63% |

Low molecular weight polymers can transfer well without flash; however, these polymers do not provide good durability. Use of a high molecular weight "tough" polymer is more effective at providing durability than a low molecular weight polymer of a similar type. Increasing the coat thickness of a low molecular weight polymer can improve durability, however, the improvement is minimal and transfer problems are introduced. Improving the transfer characteristics of a durable polymer via use of a polymer-clay nanocomposite is far more effective at achieving good transfer quality, whilst providing durability characteristics.

Figure 6:
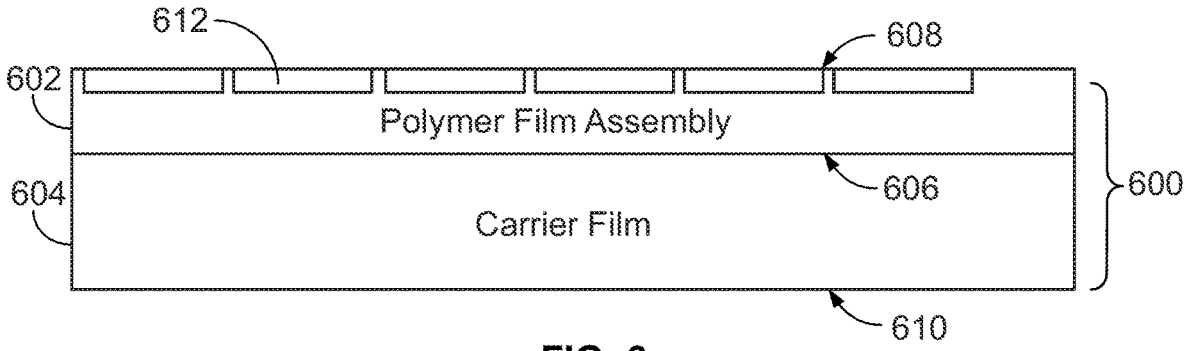
FIG. 6 illustrates a cross-sectional view of one embodiment of a thermal printing dye-sheet or ribbon.

FIG. 6 illustrates a cross-sectional view of one embodiment of a receiver sheet 600. The receiver sheet 600 optionally can be referred to as a retransfer film. The receiver sheet 600 can be used in a thermal printing, transfer, or retransfer application where materials are transferred to a surface of a target object to form images (e.g., pictures, text, numbers, symbols, other indicia, etc.). The receiver sheet or retransfer film 600 includes a polymer film assembly 602 coupled to a carrier film 604. The polymer film assembly 602 includes one or more layers of polymer material on which an image is printed before transferring some or all of the polymer film assembly 602 to the surface of a target object. In one embodiment, the polymer film assembly 602 includes a single layer, but optionally can include two or more layers connected with each other as the polymer film assembly 602. With respect to a single layer embodiment, the polymer film assembly 602 may be formed from the same material from an interface surface 606 that engages the carrier film 604 to an opposite, receiving surface 608 that faces away from the carrier film 604. Alternatively, the polymer film assembly 602 may be formed from two or more layers of polymer films having nano-sized inorganic particles described herein. When two or more layers are used the nano-sized inorganic particles can be included in any of the layers. They can be included in one of the layers of a multi-layer or added in to any further layers up to and including all layers of a multi-layer product.

The polymer film assembly 602 (or an outermost layer within the polymer film assembly 602 that is farthest from the carrier film 604) may be referred to as a receiving layer that receives dyes, pigments, inks, special effects materials, metals, mass transfer printed materials, or the like, for thermally printing onto a target object. For example, the polymer film assembly 602 receives or includes one or more areas 612 having dyes, pigments, inks, special effects materials, metals, mass transfer printed materials, etc., that are used to thermally print onto a surface of a target object, as described herein. The polymer film assembly 602 can receive the dyes, pigments, inks, special effects materials, metal, holographic images, etc., via dye diffusion printing, or mass transfer printing as described above.

Optionally, the polymer film assembly 602 can include or can be a layer having an embossed holographic image and a high refractive index layer. This can allow for transfer of the polymer film assembly 602 to a target object surface to create a holographic effect on the target object surface. The polymer film assembly 602 may be provided in a variety of thicknesses. In one example, the polymer film assembly 602 may be greater than two microns.

The carrier film 604 provides structural support to the polymer film assembly 602 during printing of an image or application of one or more dyes to the receiving surface 608, during transport of the polymer film assembly 602, and during thermal transfer of at least part of the polymer film assembly 602 to a surface of a target object. In one embodiment, the carrier film 604 is a layer of PET, such as a twelve-micron thick film of PET. Optionally, the carrier film 604 can be formed from another material and/or may have another thickness.

Figure 7:
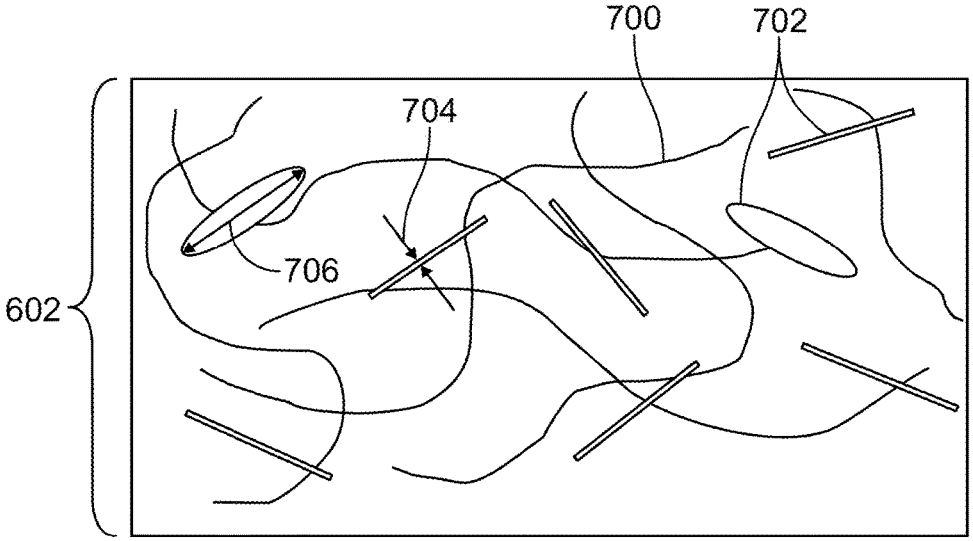
FIG. 7 schematically illustrates one example of a cross-sectional view the polymer film assembly shown in FIG. 6 or at least one layer of the polymer film assembly shown in FIG. 6.

The polymer film assembly 602 can be formed from a combination of one or more polymers and inorganic particles as described herein. FIG. 7 schematically illustrates one example of a cross-sectional view the polymer film assembly 602 or at least one layer of the polymer film assembly 602. The entire polymer film assembly 602 or at least one layer within the polymer film assembly 602 can be formed from a polymer film matrix 700 having inorganic particles 702 within the matrix 700. The particles 702 are exfoliated or intercalated particles in one embodiment, such as nano particles having at lease one dimension in the nanometer range and at least a second dimension that is significantly larger than the nanometer range. The particles 702 may be exfoliated nano-clay filler materials, as described above.

Each particle 702 may have a first outer dimension 704 that is no longer than one hundred nanometers and a second outer dimension 706 that is longer than one hundred nanometers. For example, each particle 702 may have a first outer dimension 704 in the range of one to one hundred nanometers and at least a second outer dimension 706 in the range of 0.2 to one micron. The particles 702 may have a plate shape, where the thickness 704 of each particle is one to one hundred nanometers and a diameter 706 of each particle 702 is 0.2 to one micron. The shape of the particles 702 can result in the particles 702 having an aspect ratio that is at least 1:2. Optionally, the aspect ratio of the particles 702 may be no greater than 1:1,000.

The polymer film assembly 602 may be formed in accordance with one or more of the examples described above. For example, the inorganic particles 702 may be added up to five percent by weight and/or up to three percent by volume in the polymer film matrix 700. Alternatively, the inorganic particles 702 may be added up to three percent by weight and/or up to three percent by volume in the polymer film matrix 700. As described above, the addition of the inorganic particles 702 to the film assembly 602 can improve the transfer of the film assembly 602 from the carrier film 604 to a surface of a target object being printed upon response to heat and/or pressure applied to an application surface 610 of the carrier film 604 (shown in FIG. 6). The polymer matrix 700 can provide strength to the polymer film assembly 602 in that the polymer matrix 700 can have a relatively high glass transition temperature $T_g$. For example, the polymer matrix 700 can have a glass transition temperature of at least 50° C.

Figure 8:
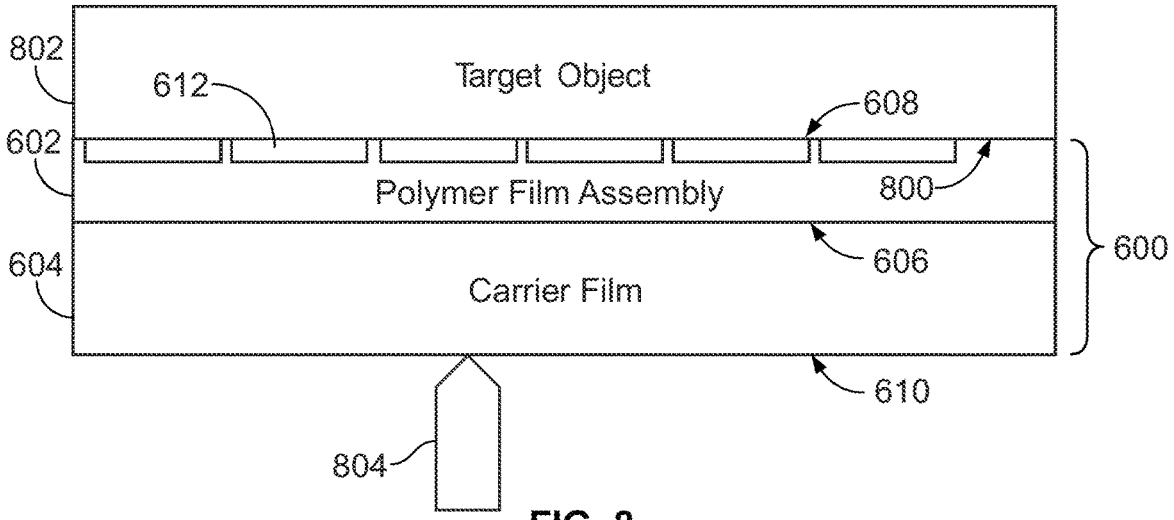
FIG. 8 illustrates one example of printing on a printing surface of a target object using the thermal printing dye-sheet or ribbon shown in FIG. 6.
Figure 9:
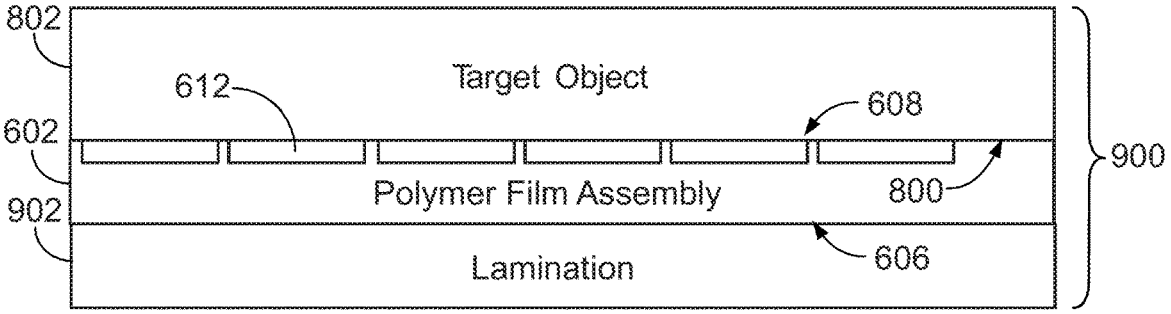
FIG. 9 also illustrates one example of printing on a printing surface of a target object using the thermal printing dye-sheet or ribbon shown in FIG. 6.

FIGS. 8 and 9 illustrate one example of printing on a printing surface 800 of a target object 802 using the receiver sheet 600 shown in FIG. 6. In one embodiment, the target object 802 can be a card, such as a PVC identification card. The printing process shown in FIGS. 8 and 9 can be a retransfer dye diffusion printing process, as described above. The polymer film assembly 602 is brought into close proximity to the printing surface 800 of the target object 802. A thermal print head or hot roll laminator 804 applies heat and/or pressure onto the surface 610 of the carrier film 604. This heat and/or pressure transfers at least part of the polymer film assembly 602 to the printing surface 800 of the target object 802 to print or otherwise form an image on the surface 800 of the target object 802. After applying the heat and/or pressure, at least part of the polymer film assembly 602 is transferred to the target object 802 to form a thermally printed object 900, as shown in FIG. 9.

This thermally printed object 900 optionally can be referred to as a multi-layered structure. The use of the nano-composite filler particles 702 in the polymer film assembly 602 allows for the polymer film assembly 602 to be separated from the carrier film 604 more easily and cleanly (e.g., no flash or extraneous portions of the polymer film assembly 602 are transferred to the target object 802), while also making the polymer film assembly 602 more transparent or have increased optical clarity. For example, a person may be able to see the printed image on the target object 802 of the structure 900 through the polymer film assembly 602, even when the polymer film assembly 602 is thick (e.g., at least two microns thick). The structure 900 can represent an identification card, a financial transaction card, or the like. For example, the structure 900 may be a predominantly planar card having dimensions that are no larger than 86 millimeters by 54 millimeters (with a thickness that is substantially smaller, such as less than 0.8 millimeters). Optionally, one or more additional layers may be added to the surface 606 of the polymer film assembly 602 after transfer of the polymer film assembly 602 to the target object 802. For example, one or more layers of lamination or a protective laminate 902 can be applied to the surface 606 to further protect the polymer film assembly 602. This lamination 902 can be transparent or translucent such that the viewer can see the image on the target object 802 through the lamination 902 and the polymer film assembly 602. Optionally, the polymer film assembly 602 can be transferred to the target object 802 and can include holographic and/or other features, such as printed security features (including but not limited to UV fluorescent features, optically variable features, tamper evident features, taggant features, etc.) so as to add an extra level of security protection to the printed target object 802.

In one embodiment, a transferable receiver material includes a polymer film assembly comprising inorganic particles having a first dimension smaller than 100 nanometers and an orthogonal, second dimension larger than 100 nanometers. The polymer film assembly can be coupled with a carrier film and the polymer film assembly can be configured to separate from the carrier film and couple with a target object surface along a defined edge upon application of heat. Optionally, the polymer film assembly includes a holographic image configured to be transferred to a target object surface upon application of heat. The polymer film assembly can be configured to receive one or more dyes, pigments, inks, special effect materials, or special effect metals for thermally transfer onto a target object.

Optionally, the inorganic particles have an aspect ratio that is at least 1:2. The aspect ratio of the inorganic particles may be no greater than 1:1,000 in at least one embodiment.

The transferable material also can include a carrier film coupled with the polymer film assembly and configured to support the polymer film assembly during application of one or more of heat or pressure to the carrier film to transfer at least part of the polymer film assembly to a target object. The polymer film assembly can include an image that is transferred to the target object upon transfer of the at least part of the polymer film assembly to the target object. The image is visible on the target object through the polymer film assembly having the inorganic particles in at least one embodiment.

The polymer film assembly can include up to 5% of the inorganic particles in one embodiment. The inorganic particles in the polymer film assembly can be surface modified with oleophilic carbon-hydrogen chains. For example, these inorganic particles optionally can be referred to as oleophilic-carbon-hydrogen-chain-surface-modified particles.

The polymer film assembly can include a single polymer layer having the inorganic particles. The polymer film assembly may include multiple polymer layers having the inorganic particles, and the multiple polymer layers can be coupled together in the polymer film assembly. For example, these multiple polymer layers can be formed separately, but connected with each other such that the polymer layers cannot be separated from each other without destroying functionality of the polymer film assembly. These multiple polymer layers do not include the carrier film that separates from the polymer film assembly upon application of heat. The polymer film assembly can be configured to receive one or more dyes, pigments, inks, special effect materials, or special effect metals via dye diffusion printing or mass transfer printing on a surface of the polymer film assembly. The polymer film assembly can be at least two microns thick.

In one embodiment, a multi-layered structure includes a planar target object having a surface and a polymer film assembly coupled with the surface of the target object. The polymer film assembly includes inorganic particles having a first dimension smaller than 100 nanometers and an orthogonal, second dimension larger than 100 nanometers. The polymer film assembly includes one or more dyes, pigments, inks, special effect materials, or special effect metals for forming an image on the target object. In one example, this structure is an identification card, but optionally, can be another object.

The inorganic particles can have an aspect ratio that is at least 1:2. The image can be visible on the target object through the polymer film assembly having the inorganic particles. The polymer film assembly can include up to 5% of the inorganic particles. The structure optionally includes a protective lamination disposed on the polymer film assembly such that the polymer film assembly is located between the protective lamination and the target object.

In one embodiment, a method is provided that includes receiving one or more dyes, pigments, inks, special effect materials, or special effect metals on a surface of a polymer film assembly. The polymer film assembly includes inorganic particles having a first dimension smaller than 100 nanometers and an orthogonal, second dimension larger than 100 nanometers. The method also includes thermally printing an image on a target object using at least part of the polymer film assembly.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are example embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A transferable material comprising:

a polymer film assembly comprising one or more of a polyester resin, an acrylic resin, or a vinyl chloride copolymer resin, the polymer film assembly also including an inorganic lamellar material formed from inorganic particles having a first dimension smaller than 100 nanometers and an orthogonal, second dimension larger than 100 nanometers, the inorganic particles including montmorillonite smectite clays and organic modifiers of the montmorillonite smectite clays, the organic modifiers including nitrogen, methyl groups, and hydrogenated tallows; and a carrier film coupled to an interface surface of the polymer film assembly, wherein the carrier film is configured to separate from the polymer film assembly along the interface surface in response to a heat application on the carrier film within the temperature range from 130° C. to 220° C.;

wherein the polymer film assembly includes one or more dyes, pigments, or inks on a receiving surface of the polymer film assembly opposite the interface surface.

2. The transferable material of claim 1, wherein the polymer film assembly includes a holographic image.

3. The transferable material of claim 1, wherein the polymer film assembly includes one or more special effect materials or special effect metals.

4. The transferable material of claim 1, wherein the inorganic particles have an aspect ratio that is at least 1:2.

5. The transferable material of claim 4, wherein the aspect ratio of the inorganic particles is no greater than 1:1,000.

6. The transferable material of claim 1, wherein the one or more dyes, pigments, or inks represent a transferable image that is visible through the polymer film assembly having the inorganic particles when viewed from the interface surface and the polymer film assembly is separated from the carrier film.

7. The transferable material of claim 1, wherein the polymer film assembly includes up to 5% of the inorganic particles.

8. The transferable material of claim 1, wherein the inorganic particles in the polymer film assembly include oleophilic carbon-hydrogen chains.

9. The transferable material of claim 1, wherein the polymer film assembly includes a single polymer layer of the one or more of the polyester resin, the acrylic resin, or the vinyl chloride copolymer resin having the inorganic particles.

10. The transferable material of claim 1, wherein the polymer film assembly includes multiple polymer layers of the one or more of the polyester resin, the acrylic resin, or the vinyl chloride copolymer resin having the inorganic particles.

11. The transferable material of claim 1, wherein the polymer film assembly is at least two microns thick.

12. A transferable material comprising:

a polymer film assembly comprising one or more of a polyester resin, an acrylic resin, or a vinyl chloride copolymer resin and inorganic plates formed from a montmorillonite smectite clay and an organic modifier of the montmorillonite smectite clay in the one or more of the polyester resin, the acrylic resin, or the vinyl chloride copolymer resin, the organic modifier including nitrogen, methyl groups, and hydrogenated tallows, the inorganic plates having an aspect ratio of at least 1:200 and no greater than 1:500, wherein the polymer film assembly includes one or more dyes, pigments, or inks on a receiving surface of the polymer film assembly; and a carrier film coupled to an interface surface of the polymer film assembly opposite the receiving surface, wherein the carrier film is configured to separate from the polymer film assembly along the interface surface in response to a heat application on the carrier film within a temperature range from 130° C. to 220° C.

13. The transferable material of claim 12, wherein the polymer film assembly includes a holographic image.

14. The transferable material of claim 12, wherein the one or more of the polyester resin, the acrylic resin, or the vinyl chloride copolymer resin includes up to 5% of the inorganic plates.

15. The transferable material of claim 12, wherein the inorganic plates include oleophilic carbon-hydrogen chains.

16. The transferable material of claim 12, wherein the one or more of the polyester resin, the acrylic resin, or the vinyl chloride copolymer resin forms a single polymer film having the inorganic plates.

17. The transferable material of claim 12, wherein the one or more of the polyester resin, the acrylic resin, or the vinyl chloride copolymer resin includes multiple polymer layers having the inorganic plates.

* * * * *